US008425131B2

(12) United States Patent
Shishido

(10) Patent No.: US 8,425,131 B2
(45) Date of Patent: Apr. 23, 2013

(54) PRINTING APPARATUS AND ROLL PAPER HOLDING APPARATUS

(75) Inventor: Norifumi Shishido, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 620 days.

(21) Appl. No.: 12/691,111

(22) Filed: Jan. 21, 2010

(65) Prior Publication Data

US 2010/0202817 A1 Aug. 12, 2010

(30) Foreign Application Priority Data

Feb. 10, 2009 (JP) ..... 2009-029010

(51) Int. Cl.
*B41F 15/04* (2006.01)

(52) U.S. Cl.
USPC ..... 400/611; 400/613; 400/692; 242/597.1

(58) Field of Classification Search ..... 400/613, 400/611, 614, 692, 693; 242/597, 597.1, 242/597.8
See application file for complete search history.

(56) References Cited

U.S. PATENT DOCUMENTS

| | | | | |
|---|---|---|---|---|
| 4,641,980 | A * | 2/1987 | Matsumoto et al. | 400/693 |
| 6,367,731 | B1 | 4/2002 | Takizawa et al. | |
| 2010/0111586 | A1 * | 5/2010 | Kawabe et al. | 400/613 |

FOREIGN PATENT DOCUMENTS

| | | | |
|---|---|---|---|
| JP | 61084269 | | 4/1986 |
| JP | 61118756 | | 6/1986 |
| JP | 1127851 | | 8/1989 |
| JP | 02038080 | A * | 2/1990 |
| JP | 02038238 | | 2/1990 |
| JP | 07256982 | | 10/1995 |
| JP | 09-254476 | | 9/1997 |
| JP | 2000-095397 | | 4/2000 |
| JP | 2001080803 | | 3/2001 |
| JP | 2003-026356 | | 1/2003 |
| JP | 2007-160801 | | 6/2007 |

OTHER PUBLICATIONS

Japanese Office Action dated Nov. 16, 2010 corresponding to U.S. Appl. No. 12/691,111 filed on Jan. 21, 2010.
Decision of Patent Grant for Japanese Application No. 2011-034982 mailed on May 8, 2012.
Japanese Office Action for Japanese Application No. 2011-034982 mailed on Dec. 20, 2011.

* cited by examiner

*Primary Examiner* — Leslie J Evanisko
(74) *Attorney, Agent, or Firm* — Turocy & Watson, LLP

(57) ABSTRACT

A roll paper holding apparatus includes a pull-out unit which can be pulled out and housed through an opening formed in a printing apparatus main body, a paper holding section which is provided in the pull-out unit and rotatably holds a roll paper in which a paper is wound into a roll shape, a contact body which is provided in the pull-out unit, and is openable and closable to the paper holding section according to a pull-out operation and a housing operation of the pull-out unit with respect to the printing apparatus main body, and an urging section which is provided in the pull-out unit, and urges the contact body opened to the paper holding section in a direction of contacting with a frame forming the opening of the printing apparatus main body when the pull-out unit is pulled out from the printing apparatus main body.

9 Claims, 5 Drawing Sheets

PRINTING APPARATUS AND ROLL PAPER HOLDING APPARATUS

CROSS-REFERENCE TO RELATED APPLICATION

This application is based upon and claims the benefit of priority from Japanese Patent Application No. 2009-029010, filed on Feb. 10, 2009, and the entire contents of the Japanese Patent Application are incorporated herein by reference.

TECHNICAL FIELD

The present invention relates to a roll paper holding apparatus to rotatably hold a roll paper housed in the inside of a printing apparatus, a printing apparatus to print on a roll paper housed in the inside of the apparatus, and a holding method of a roll paper holding apparatus to hold the roll paper holding apparatus housed in the inside of a printing apparatus in a state of being exposed to the outside of a printing apparatus main body.

BACKGROUND

Hitherto, there is a printer which prints information relating to an article, and issues a printed material as a label or a receipt. In such a printer, printing is performed on the surface of a thin sheet member such as a paper. A printer as disclosed in, for example, JP-A-7-256982 has a space to contain a roll paper in the inside of a housing as an apparatus main body. The roll paper is rolled so that one end of a thin and long band-like paper becomes the inner side. The outside end of the roll paper is separated from the outer periphery of the roll paper, and is guided to a print section to perform printing. The print section prints on the outer surface (outer peripheral surface) or inner surface (inner peripheral surface) of the paper pulled out from the outer periphery of the roll paper.

Besides, in a printer as disclosed in, for example, JP-UM-A-1-127851, a space to contain a roll paper, together with a member surrounding the space, is slidably pulled out from the inside of a main body of the apparatus to the outside of the main body. In such a printer, when a new roll paper is replenished, the space to contain the roll paper is pulled out from the apparatus main body, and the roll paper is mounted at a specified place in the state where it is pulled out.

However, when the containing space for the roll paper is pulled out from the apparatus main body and the replenishing operation of the roll paper is performed, the hand or arm of the operator may touch the member surrounding the containing space for the roll paper. When the operator touches the member surrounding the containing space for the roll paper, the roll paper containing space pulled out to the outside of the apparatus main body is moved to the inside of the apparatus main body. Accordingly, there is a problem that the position of the place where the roll paper is mounted does not stabilize, and the replenishing operation of the roll paper is difficult.

SUMMARY

According to an aspect of the invention, a roll paper holding apparatus includes a pull-out unit which can be pulled out and housed through an opening formed in a printing apparatus main body, a paper holding section which is provided in the pull-out unit and rotatably holds a roll paper in which a paper is wound into a roll shape, a contact body which is provided in the pull-out unit, and is openable and closable to the paper holding section according to a pull-out operation and a housing operation of the pull-out unit with respect to the printing apparatus main body, and an urging section which is provided in the pull-out unit, and urges the contact body opened to the paper holding section in a direction of contacting with a frame forming the opening of the printing apparatus main body when the pull-out unit is pulled out from the printing apparatus main body.

According to another aspect of the invention, a printing apparatus includes an opening formed in an apparatus main body, a print head provided at an upper part in the opening, a pull-out unit which can be pulled out and housed through the opening, a paper holding section which is provided in the pull-out unit and rotatably holds a roll paper in which a paper is wound into a roll shape, a platen which is provided in the pull-out unit, supports the paper pulled out from the roll paper held by the paper holding section from below, faces the print head when the pull-out unit is housed in the opening, and regulates a gap between the paper and the print head, a contact body which is provided in the pull-out unit, and is openable and closable to the paper holding section according to a pull-out operation and a housing operation of the pull-out unit with respect to the apparatus main body, and an urging section which is provided in the pull-out unit, and urges the contact body opened to the paper holding section in a direction of contacting with a frame forming the opening of the apparatus main body when the pull-out unit is pulled out from the apparatus main body.

Besides, according to another aspect of the invention, a holding method of a roll paper holding apparatus to hold the roll paper holding apparatus in a state of being exposed outside a printing apparatus main body to house the roll paper holding apparatus, wherein the roll paper holding apparatus includes a pull-out unit which can be pulled out and housed through an opening formed in the printing apparatus main body includes: rotatably holding a roll paper, in which a paper is wound into a roll shape, by a paper holding section provided in the pull-out unit; opening and closing a contact body provided in the pull-out unit to the paper holding section according to a pull-out operation and a housing operation of the pull-out unit with respect to the printing apparatus main body; and urging, by an urging section provided in the pull-out unit, the contact body opened to the paper holding section in a direction of contacting with a frame forming the opening of the printing apparatus main body when the pull-out unit is pulled out from the printing apparatus main body.

DETAILED DESCRIPTION

Hereinafter, embodiments of a roll paper holding apparatus, a printing apparatus, and a holding method of a roll paper holding apparatus according to the present invention will be described with reference to the accompanying drawings. Hereinafter, an example will be described in which the printing apparatus of the invention is applied to a printer to issue a label or a receipt on which information relating to an article such as food is printed. However, no limitation is made to this, and the invention may be applied to any apparatus as long as the apparatus prints various information on a recording medium such as a paper.

Figure 1:
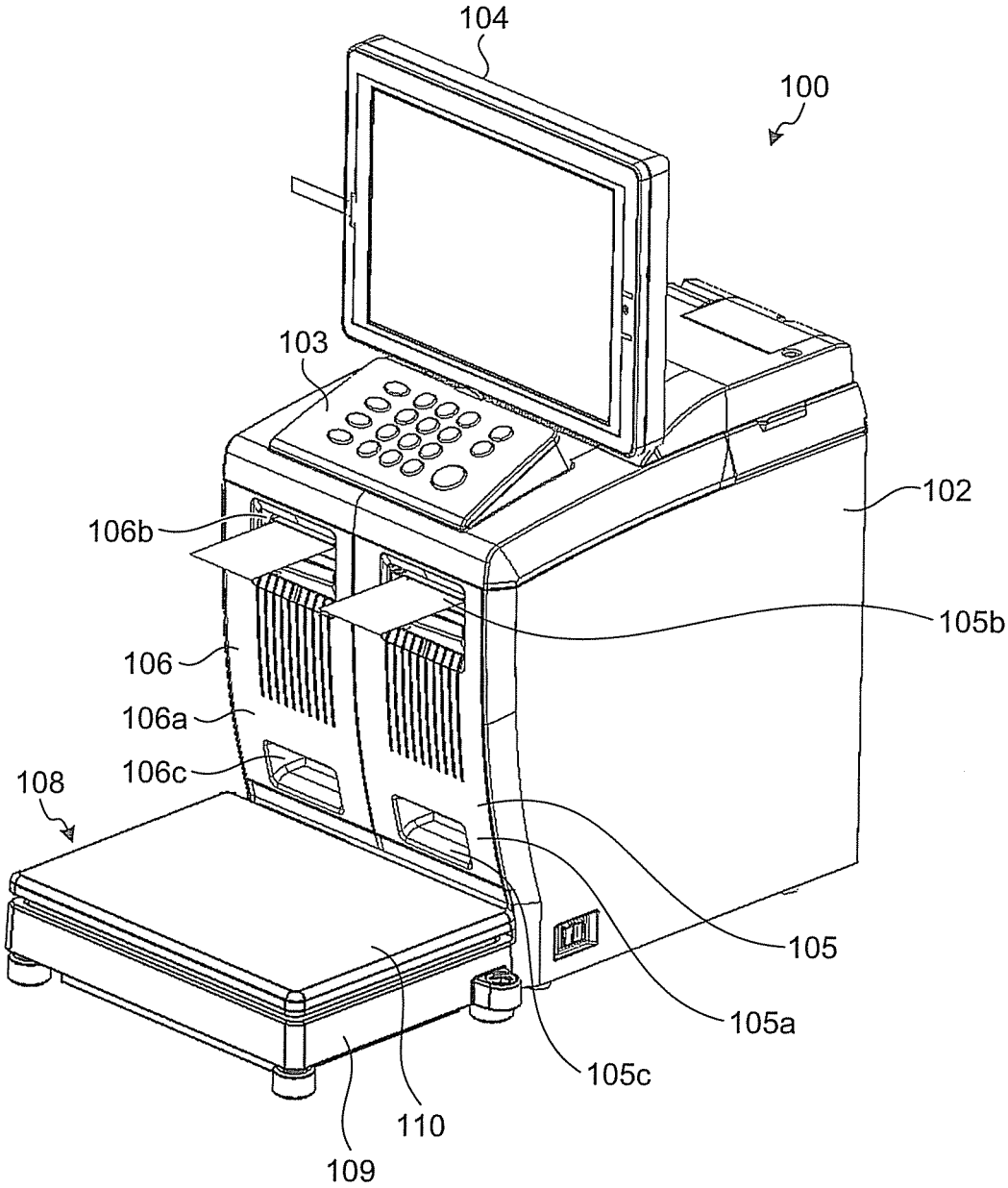
FIG. 1 is a perspective view showing an outer appearance of a printer.

FIG. 1 is a perspective view showing an outer appearance of a printer 100. The printer 100 includes a substantially rectangular parallelepiped housing 102. In the housing 102, an operation panel 103 including various keys such as a numeric keypad, and a display 104 as a display section having a liquid crystal display are provided on an upper surface. The housing 102 has an opening on the front side, and two pull-out units 105 and 106 are housed side by side in the inside thereof.

Front panels 105*a* and 106*a* are attached to the fronts of the pull-out units 105 and 106. The front panels 105*a* and 106*a* are provided with issue ports 105*b* and 106*b* at upper parts. The front panels 105*a* and 106*a* have grip sections 105*c* and 106*c* at lower parts. Besides, in the housing 102 in which the opening is formed in the front direction of the apparatus main body, the pull-out units 105 and 106 are attached to be capable of being pulled out and housed. The operator holds the grip sections 105*c* and 106*c*, and can pulled out the pull-out units 105 and 106 from the housing 102.

In FIG. 1, a measuring device 108 is adjacently disposed at the front of the printer 100. The measuring device 108 includes a flat-shaped main body device 109 and a measuring plate 110 attached to an upper surface of the main body device 109. The main body device 109 has a function to measure the weight of an article placed on the measuring plate 110 and to output measurement data. The printer 100 is electrically connected to the measuring device 108. The measuring device 108 inputs the outputted measurement data to the printer 100.

Figure 2:
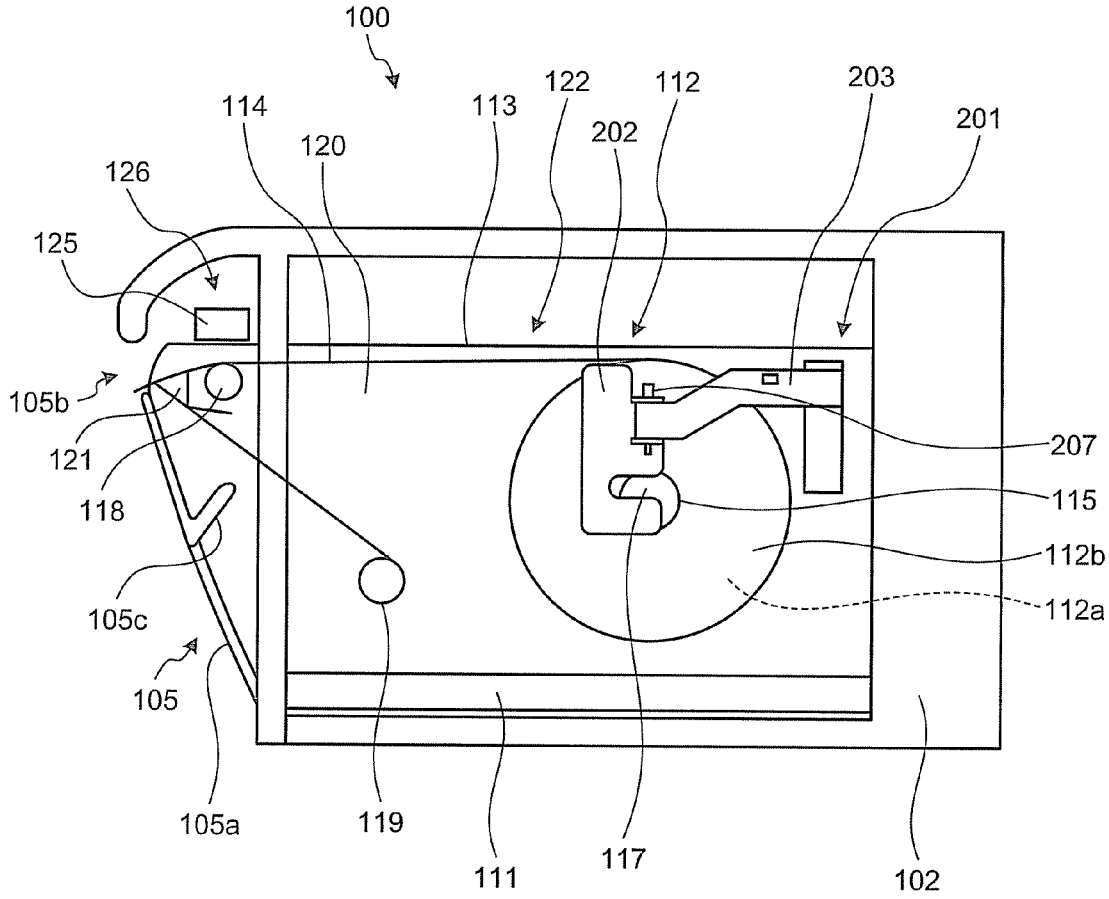
FIG. 2 is a schematic sectional view of the printer in a state where a pull-out unit is housed.

FIG. 2 is a schematic sectional view of the printer 100 in a state where the pull-out unit 105 is housed in the housing 102. FIG. 2 shows the one pull-out unit 105 of the two pull-out units 105 and 106, which is positioned at the right side when viewed from the front side of the printer 100. The other pull-out unit 106 positioned at the left side has a structure symmetrical to the pull-out unit 105 shown in FIG. 2. Hereinafter, only the pull-out unit 105 positioned at the right side will be described, and the description of the pull-out unit 106 positioned at the left side will be omitted.

In this embodiment, a label paper 112 used for the pull-out unit 105 is a roll paper wound into a roll shape. The label paper 112 is such that plural labels 113 are bonded in a line to a long backing paper 114, are wound around a paper pipe 115 and are wound into a roll shape. As the label 113, a thermosensitive label colored by heating is used.

The pull-out unit 105 includes a paper holding shaft 117, a platen 118 and a backing paper winding shaft 119. The paper holding shaft 117 receives the paper pipe 115 and holds the label paper 112. The platen 118 conveys the label paper 112. The backing paper winding shaft 119 winds the backing paper 114 of the label paper 112. The paper holding shaft 117, the platen 118, and the backing paper winding shaft 119 protrude in a cantilever state from a side wall 120 of the pull-out unit 105. In the pull-out unit 105, by the paper holding shaft 117 and the backing paper winding shaft 119, a guide path 122 of the label paper 112 from the paper holding shaft 117 to the backing paper winding shaft 119 is formed.

In the pull-out unit 105, a peeling section 121 is disposed in the vicinity of the downstream side of the platen 118 in the guide path 122. The peeling section 121 bends only the backing paper 114 of the label paper 112 at an acute angle in a direction of separating from the label 113. The peeling section 121 peels the printed label 113 from the backing paper 114, issues it from the issue port 105*b*, bends the backing paper 114, and guides it to the backing paper winding shaft 119.

As stated above, in the pull-out unit 105, the paper holding shaft 117 is horizontally kept in the cantilever state to the side wall 120, and holds the label paper 112 in the state where it is inserted in the paper pipe 115 of the label paper 112. That is, the side wall 120 contacts with a first end face 112*a* as one end face of the label paper 112, and functions as a reference surface to position the label paper 112. Besides, the paper holding shaft 117 functions as a paper holding section to rotatably hold the label paper 112 wound into a roll shape with reference to the end face based on the side wall 120 as the reference surface.

A rotation member 202 urges, not the side wall 120 side (further side in FIG. 2) of the label paper 112 held by the paper holding shaft 117, but the opposite side, that is, a second end face 112*b* directed to the open side (nearer side in FIG. 2) of the label paper 112, and pushes the label paper 112 in the width direction (axial direction of the paper holding shaft 117). The first end face 112*a* of the label paper 112 contacts with the side wall 120 as the reference surface. Accordingly, the side wall 120 and the rotation member 202 pinch the label paper 112, and regulate the movement in the width direction when the label paper 112 is pulled along the guide path 122.

The rotation member 202 is rotatably attached through a rotation member rotation shaft 207 to an end of an arm main section 203 as a part of a roll paper holding apparatus 201. When the arm main section 203 rotates and interferes with the second end face 112*b* of the label paper 112, the rotation member 202 is rotated and displaced. The details of the structure of the roll paper holding apparatus 201 including the rotation member 202 and the arm main section 203 will be described later with reference to FIGS. 4 and 5.

In the pull-out unit 105, the platen 118 is disposed below the guide path 122. The platen 118 rotates by receiving drive force from a platen motor (not shown) through a gear train (not shown), applies conveyance force to the label paper 112 on the guide path 122, and pulls out the label paper 112 held by the paper holding shaft 117 along the guide path 122. As stated above, the platen 118, the platen motor and the gear train function as a conveyance section to pull out the label paper 112 and to convey it along the guide path 122.

The backing paper winding shaft 119 rotates by receiving drive force from a winding motor (not shown) through a gear train (not shown) arranged on the back side of the side wall 120, and winds only the backing paper 114 of the label paper 112 passing through the peeling section 121. In the pull-out unit 105, the peeling section 121 and the backing paper winding shaft 119 are respectively positioned at positions where the backing paper winding shaft 119 winds the backing paper 114 and the backing paper 114 is bent at an acute angle in the portion of the peeling section 121.

The housing 102 is provided with a pair of rails 111 at inner lower parts. The rails 111 horizontally extend from the opening provided at the front side of the housing 102 to the further side, and slidably support the pull-out unit 105. Thus, the operator holds the grip section 105*c* of the pull-out unit 105 to pull out it, slidingly moves the pull-out unit 105 in the front direction along the rails 111, and can position it from a state (FIG. 2) where it is housed in the housing 102 to a state (see FIG. 3) where it is pulled out to the outside of the housing 102. Besides, the operator holds the grip 105*c*, slidingly moves the pull-out unit 105 along the rails 111 in the further side direction, and can also position it from the pulled-out state (see FIG. 3) to the housed state (FIG. 2).

A thermal head 125 as a print head is provided at an inner upper part of the housing 102. The thermal head 125 is a line-type thermal print head, and in the housing 102, the thermal head 125 is attached to a position where the thermal head faces the platen 118 in a state where the pull-out unit 105 is housed in the housing 102. The thermal head 125, together with the platen 118, constitutes a print section 126.

Figure 3:
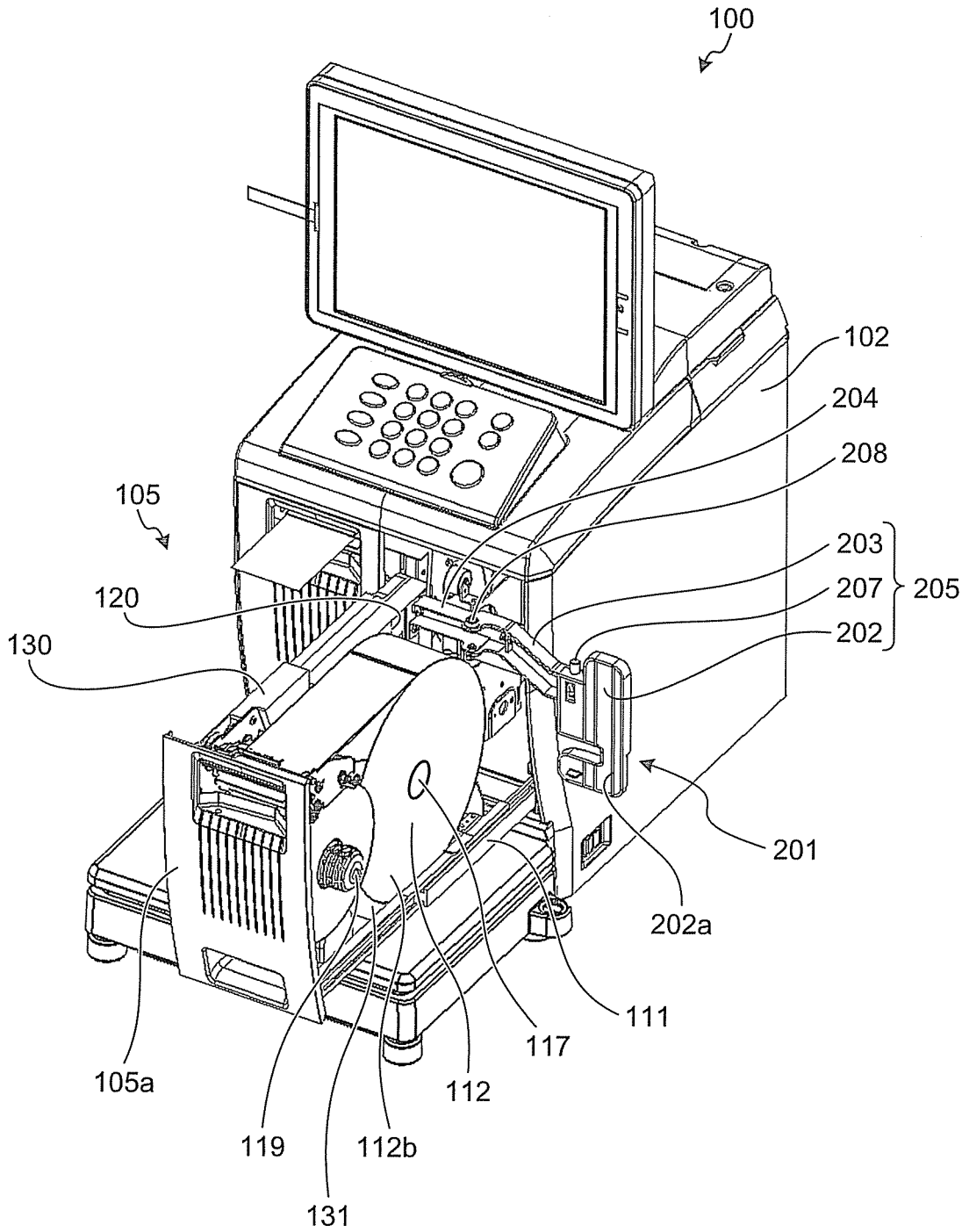
FIG. 3 is a perspective view showing a state where the pull-out unit is pulled out from a housing.

FIG. 3 is a perspective view showing a state where the pull-out unit 105 is pulled out from the housing 102. A side frame 130 having the side wall 120 and a bottom frame 131 as a bottom constitute the framework of the pull-out unit 105. The side frame 130 is fixed and attached to one side of the bottom frame 131. Thus, the pull-out unit 105 has a substantially L shape when viewed from the front side. The side wall 120 of the side frame 130 supports the paper holding shaft 117 and the backing paper winding shaft 119 in the cantilever state and in parallel to the bottom frame 131. The housing 102 slidably supports both side portions of the bottom frame 131 through the rails 111.

The printer 100 of the embodiment is inclined so that the side of the front panels 105*a* and 106*a* is higher than the further side when the pull-out units 105 and 106 are housed. By this inclination, since force is applied by the gravity to the pull-out units 105 and 106 in a direction in which they are housed in the housing 102, it is prevented that the pull-out units 105 and 106 are unnecessarily pulled out, and the printer 100 is inclined to the side of the print panels 105*a* and 106*a* and falls down.

Figure 4:
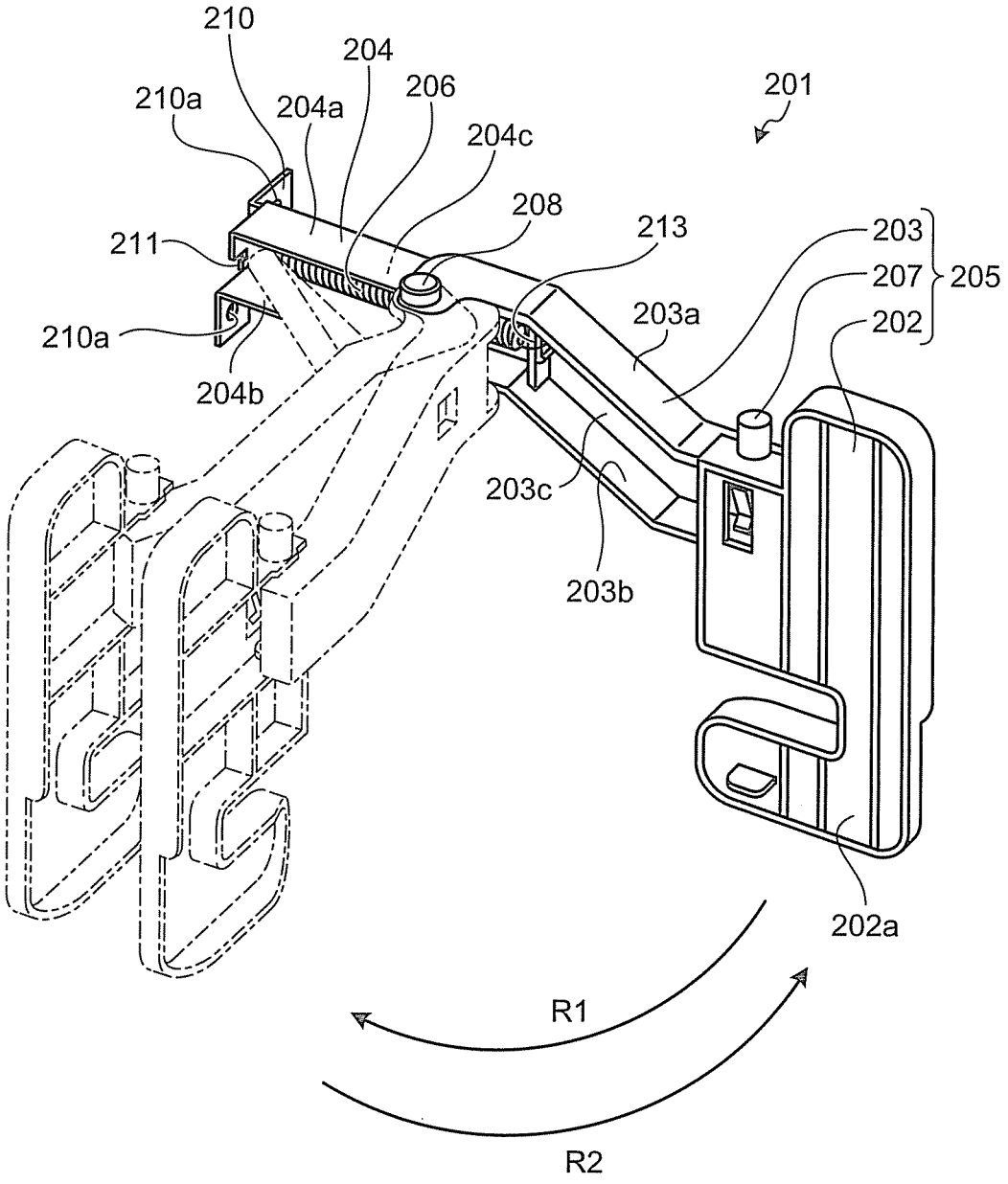
FIG. 4 is a perspective view showing the details of a roll paper holding apparatus.

Here, the roll paper holding apparatus 201 will be described. FIG. 4 is a perspective view showing the details of the roll paper holding apparatus 201. As shown in FIGS. 3 and 4, the roll paper holding apparatus 201 includes a first arm 204, a second arm 205, and a spring 206 (urging section). The roll paper holding apparatus 201 has a structure so that it can contact with the second end face 112*b* of the label paper 112 held by the paper holding shaft 117 or can contact with the frame of the housing 102.

The rotation member 202 and the arm main section 203 are rotatably connected through the rotation member rotation shaft 207, and constitute the second arm 205. The second arm 205 is rotated and displaced around a vertical shaft 208 in the vicinity of one end connected to the first arm 204, and functions as a contact body to contact with the second end face 112*b* of the label paper 112 at the free end side (other end side). The second arm 205 is openable and closable to the paper holding section including the paper holding shaft 117 and the side wall 120 according to the pull-out operation and the housing operation of the pull-out unit 105 with respect to the housing 102 (apparatus main body).

The first arm 204 is fixed and attached to a further side upper end position of the side frame 130 when the pull-out unit 105 is housed in the housing 102, and protrudes from the side wall 120 in the same direction as the paper holding shaft 117 and the backing paper winding shaft 119. The first arm 204 is formed to have a C-shaped section, and rotatably supports the arm main section 203 by both end faces opposite to each other. By this, the arm main section 203 can be rotated around the vertical shaft 208 so that the portion at the free end side, which is not supported by the first arm 204, approaches to and separates from the second end face 112*b* of the label paper 112 held by the paper holding shaft 117.

The rotation member 202 is attached to the end of the arm main section 203 at the free end side so as to be rotatable around the vertical shaft 208 through the rotation member rotation shaft 207. The rotation member 202 has a contact face 202*a* to contact with the second end face 112*b* of the label paper 112.

The spring 206 is stretched between the first arm 204 and the arm main section 203. One end of the spring 206 is connected to the vicinity of the root of the first arm 204 attached to the side wall 120, and the other end is connected to a place of the arm main section 203 in the vicinity of the vertical shaft 208. The spring 206 pulls and urges the second arm 205 (the rotation member 202 and the arm main section 203) opened to the paper holding section in a first rotation direction (an arrow R2 direction in FIG. 4) of approaching the frame forming the opening of the housing 102. Besides, the spring 206 pulls and urges the second arm 205 closed to the paper holding section in a second rotation direction (an arrow R1 direction in FIG. 4) which is a direction of approaching the second end face 112*b* of the label paper 112 and is an opposite direction to the first rotation direction.

As stated above, in the roll paper holding apparatus 201, the spring 206 urges the second arm 205 to rotate in the arrow R1 direction, so that the rotation member 202 of the second arm 205 contacts with the second end face 112*b*, the first end face 112*a* of the label paper 112 contacts with the side wall 120 as the reference surface, and the movement of the label paper 112 in the width direction is regulated.

On the other hand, in the roll paper holding apparatus 201, when the pull-out unit 105 is pulled out from the housing 102, the spring 206 urges the second arm 205 in the arrow R2 direction, so that the arm main section 203 of the second arm 205 contacts with the frame of the housing 102, and it is possible to prevent the pull-out unit 105 from moving to the inside of the housing 102. Since the printer 100 of the embodiment is inclined so that the front panel 105*a* side becomes high, when the pull-out unit 105 is pulled out in a replenishing operation of the label paper 112, it is prevented that the pull-out unit 105 is housed in the housing 102 by the gravity.

The roll paper holding apparatus 201 will be described in more detail. The first arm 204 is the long member having the C-shaped section, and includes a C-shaped upper piece 204*a*, a C-shaped lower piece 204*b*, and a C-shaped side 204*c* to connect these. Besides, the first arm 204 includes a flat plate-shaped attachment contact section 210 directed in a C-shaped section direction at the end opposite to the end to which the second arm 205 is connected. The attachment contact section 210 has an attachment hole 210*a* for fixing and attaching the first arm 204 to the side wall 120 of the pull-out unit 105 by screwing or the like. The attachment contact section 210 is provided with a spring attachment section 211 for attaching one end of the spring 206. A stopper (not shown) is provided to protrude at the end of the C-shaped side 204*c* on the arm main section 203 side.

Besides, the arm main section 203 is long and has a C-shaped section which can be inscribed to the first arm 204, is a member formed into such a shape that a portion at the rotation member 202 side shifts downward, and includes a C-shaped upper piece 203*a*, a C-shaped lower piece 203*b*, and a C-shaped side 203*c* to connect these. A spring attachment section 213 for attaching the other end of the spring 206 is provided in a portion of the C-shaped side 203*c* at the first arm 204 side. Besides, a stepped part (not shown) which contacts with the stopper of the first arm 204 is formed on the C-shaped outside of the C-shaped side 203*c*.

The first arm 204 and the arm main section 203 are rotatably connected at the vertical shaft 108 by a headed shaft with a cut groove on a shaft part, and an E-ring fitted in the cut groove. The rotation member rotation shaft 207 is inserted through the end of the arm main section 203 at the opposite side to the end connected to the first arm 204, and the rotation member 202 is rotatably attached.

Figure 5:
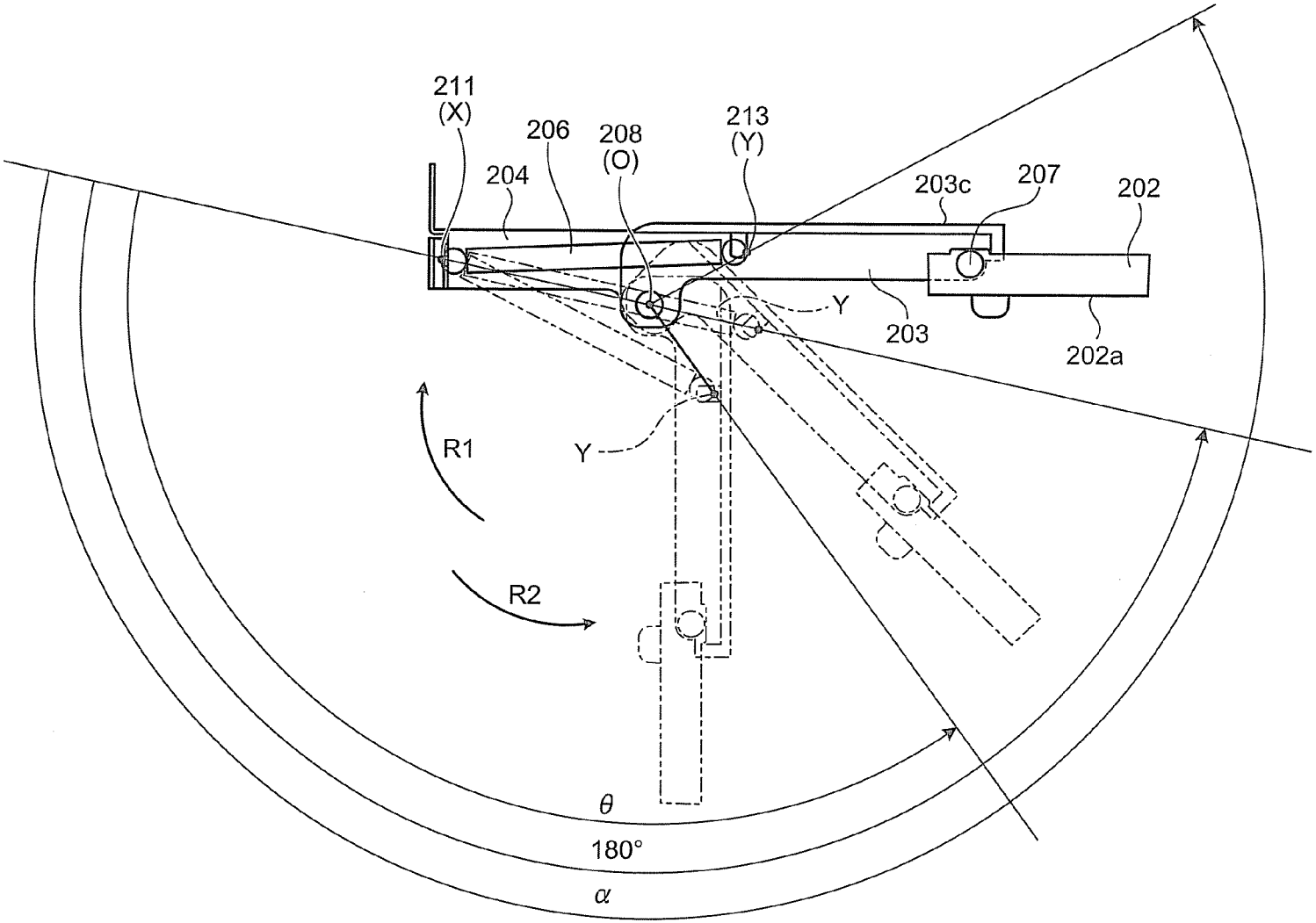
FIG. 5 is a schematic plan view showing an operation of the roll paper holding apparatus.

FIG. 5 is a schematic plan view showing an operation of the roll paper holding apparatus 201. Both the ends of the spring 206 are respectively attached to the spring attachment section 211 provided in the first arm 204 and the spring attachment section 213 provided in the arm main section 203. Here, an angle between a half line OX extending from the vertical axis 208 (point O) to the spring attachment section 211 (point X) in the first arm 204 and a half line OY extending from the vertical axis 208 (point O) to the spring attachment section 213 (point Y) in the arm main section 203 is made θ.

When the first arm 204 and the arm main section 203 are in a positional relation of θ<180° (position of the arm main section 203 at this time is indicated by a two-dot chain line in FIG. 5), the spring 206 pulls and urges the arm main section 203 such that the contact face 202*a* of the rotation member 202 is rotated and displaced in the second rotation direction (arrow R1 direction) of approaching the second end face 112*b* of the label paper 112. In this case, the rotation member 202 contacts with the second end face 112*b*, so that the movement of the label paper 112 in the width direction can be regulated.

When the arm main section 203 is positioned at a position of θ>180° with respect to the first arm 204, the spring 206 pulls and urges the arm main section 203 so as to be rotated and displaced in the first rotation direction (arrow R2 direction) of separating the contact face 202*a* of the rotation member 202 from the second end face 112*b* of the label paper 112 and causing it to approach the frame of the housing 102. In this case, the arm main section 203 is brought into contact with the frame of the housing 102, so that it is prevented that the pull-out unit 105 moves to the inside of the housing 102.

Incidentally, in the case of θ=180°, the arm main section is urged neither in the first rotation direction nor in the second rotation direction. The position of the arm main section 203 in this case is indicated by an alternate long and short dash line in FIG. 5.

When the arm main section 203 is positioned at a position of θ=specified angle α (α>)180° in the process of rotation and displacement in the first rotation direction (arrow R2 direction) (position of the arm main section 203 at this time is indicated by a solid line in FIG. 5), the stepped part (not shown) formed on the C-shaped side 203*c* collides with the stopper (not shown) provided on the first arm 204, and the arm main section is stopped at the position of θ=specified angle α. That is, the stopper and the stepped part constitute a holding mechanism to hold the arm main section 203 at the position of θ=specified angle α.

The attachment position in the horizontal direction when the roll paper holding apparatus 201 is attached to the housing 201 will be described. The first arm 204 of the roll paper holding apparatus 201 is attached to the side wall 120 of the side frame 130 so that, in the state where the rotation member 202 contacts with the second end face 112*b* of the label paper 112, the second arm 205 presses the second end face 112*b* of the label paper 112 without being disturbed by the housing 102 when the pull-out unit 105 is pulled out or is housed. Besides, the first arm 204 of the roll paper holding apparatus 201 is attached to the side wall 120 of the side frame 130 so that, in the state where the arm main section 203 is held by the holding mechanism including the stopper and the stepped part, the rotation member 202 positioned across the passing space of the housing 102 protrudes rightward from the frame forming the opening of the housing 102.

In the printer 100 of the embodiment constructed as described above, when electric power is fed from the commercial power source, a microcomputer (not shown) incorporated in the housing 102 drives and controls the respective sections, and executes a print process. When this print process is performed, in the printer 100, the platen 118 rotates to convey, along the guide path 122, the label paper 112 held by the paper holding shaft 117 by inserting the paper pipe 115, and printing based on print data is performed on the label paper 112 by the thermal head 125. The print data includes, for example, measurement data of an article placed on the measurement plate 110 outputted by the main body device 109 of the measuring device 108. As stated above, simultaneously with the print process, the microcomputer drives and controls the winding motor (not shown) to rotate the backing paper winding shaft 119, and also performs a process of winding the backing paper 114 as a part of the label paper 112. In the printer 100, the printed label 113 is peeled from the backing paper 114 by the peeling section 121, and is issued from the issue port 105*b*.

The control and drive of the respective sections is performed, so that the label paper 112 fixed to the paper holding shaft 117 is pulled by the platen 118 and is rotated around the axis of the paper holding shaft 117, and is also moved in the axial direction (width direction of the label paper 112) of the paper holding shaft 117, and the second end face 112*b* contacts with the contact face 202*a* of the rotation member 202 constituting the roll paper holding apparatus 201. The spring 206 urges the rotation member 202 in the direction toward the side wall 120 of the side frame 130 by the urging force in the second rotation direction (the arrow R1 direction in FIG. 4). Thus, the label paper 112 is urged by the rotation member 202, the first end face 112*a* of the label paper 112 contacts with the side wall 120 as the reference surface, and the label paper is sandwiched between the side wall 120 and the rotation member 202 and does not move in the width direction. In addition, since the rotation member 202 rotates around the axis of the rotation member rotation shaft 207 in the vertical direction, irrespective of the sheet width of the label paper 112 fixed to the paper holding shaft 117, the contact face 202*a* of the rotation member 202 is fitted to the second end face 112*b* of the label paper 112, and the movement of the label paper 112 in the width direction can be certainly regulated.

Besides, in the roll paper holding apparatus 201 of this embodiment, the arm main section 203 can be held in the open state by the holding mechanism (the stopper of the first arm 204 and the stepped part of the arm main section 203). Thus, the operator can easily perform the operation to fix the label paper 112 to the paper holding shaft 117 in the state where the pull-out unit 105 is pulled out from the housing 102 and without holding the arm main section 203 by the hand.

Besides, in the roll paper holding apparatus 201 of this embodiment, when the pull-out unit 105 is pulled out, the spring 206 urges the arm main section 203 by the urging force in the first rotation direction (the arrow R2 direction in FIG. 4). Thus, the arm main section 203 contacts with the housing 102, and prevents the pull-out unit 105 from moving to the inside of the housing 102, and the pull-out unit 105 becomes stable. Thus, the replenishing operation of the label paper 112 can be easily performed.

Ad described above, in the printer 100 of this embodiment, the regulation of the movement of the label paper 112 in the width direction, and prevention of the movement of the pull-out unit 105 into the apparatus main body at the replenishing operation of the label paper 112 can be realized in such a simple manner that the roll paper holding apparatus 201 using only the simple components such as the spring 206 and the first arm 204 is fixed and attached to the pull-out unit 105 by screwing or the like. Accordingly, oblique movement of the roll paper can be prevented by the simple structure, and the replenishing operation of the label paper 112 can be easily performed.

Incidentally, the event of "new roll paper is replenished" in the replenishing operation of the label paper 112 which is the roll paper wound into a roll shape is not limited to "replacement of the roll paper". In recent years, as the label paper 112, a roll paper without a core (paper pipe) or a label roll paper without a backing paper is also known. In the printer to print on the label paper 112 as stated above, another replenish mode of the roll paper is adopted in which the label paper 112 as the roll paper is not replaced, but a label paper 112 as a new roll paper is inserted to the shaft. That is, the event of "new roll paper is replenished" is a replacement operation of a core (paper pipe 115) to the paper holding shaft, in which the paper pipe 115 (core) in a state where the paper is not wound (or the paper which can not be further pulled out is wound) is drawn out from the paper holding shaft 117, and instead of the drawn paper pipe 115 (core), another paper pipe 115 (core) in a state where a paper which can be pulled out is wound is inserted to the paper holding shaft 17. Besides, the event of "new roll paper is replenished" is an operation in which the backing paper 114 wound around the backing paper winding shaft 119 is pulled out from the backing paper winding shaft 119, and a backing paper of a newly held roll paper is wound around (reeled by) the paper holding shaft 117.

Further effects and modified examples can be easily derived by a skilled person. Thus, the wider mode of the invention is not limited to the specific details and the typical embodiment represented and described above. Accordingly, various modifications can be made without departing from the spirit or scope of the general inventive concept defined by the appended claims and their equivalent.

What is claimed is:

1. A roll paper holding apparatus comprising:

a pull-out unit which can be pulled out and housed through an opening formed in a printing apparatus main body;

a paper holding section which is provided in the pull-out unit and rotatably holds a roll paper in which a paper is wound into a roll shape;

a contact body which is provided in the pull-out unit, and contacts with a frame of the opening when being rotated in a first rotation direction in which the paper holding section is opened according to a pull-out operation of the pull-out unit with respect to the printing apparatus main body and contacts with a side surface of the roll paper held by the paper holding section when being rotated in a second rotation direction which is opposite to the first rotation direction according to a housing operation of the pull-out unit with respect to the printing apparatus main body; and an urging section which is provided in the pull-out unit, and urges the contact body opened to the paper holding section in the first rotation direction when the pull-out unit is pulled out from the printing apparatus main body and urges the contact body in the second rotation direction when the pull-out unit is housed in the printing apparatus main body.

2. The apparatus of claim 1, wherein the paper holding section has a reference surface which contacts with a first end face of the roll paper and positions the roll paper.

3. An apparatus, comprising:

a pull-out unit which can be pulled out and housed through an opening formed in a printing apparatus main body;

a paper holding section which is provided in the pull-out unit and rotatably holds a roll paper in which a paper is wound into a roll shape;

a contact body which is provided in the pull-out unit, and is openable and closable to the paper holding section according to a pull-out operation and a housing operation of the pull-out unit with respect to the printing apparatus main body; and an urging section which is provided in the pull-out unit, and urges the contact body opened to the paper holding section in a direction of contacting with a frame forming the opening of the printing apparatus main body when the pull-out unit is pulled out from the printing apparatus main body, wherein the urging section urges the contact body opened to the paper holding section in a first rotation direction of approaching the frame when the pull-out unit is pulled out from the printing apparatus main body, and the contact body has a contact section to contact with an open side second end face of the roll paper held by the paper holding section, and the contact section is provided to be positioned at a free end side and to be rotatable.

4. The apparatus of claim 3, wherein the urging section urges the contact body closed to the paper holding section in a direction of causing the contact section to approach the second end face of the roll paper and in a second rotation direction opposite to the first rotation direction, and causes the contact section to contact with the second end face.

5. The apparatus of claim 4, further comprising a first arm protruding from the reference surface to a side where the roll paper is positioned by the paper holding section.

6. The apparatus of claim 5, wherein the contact body is a second arm supported at a support point O rotatably with respect to the first arm.

7. The apparatus of claim 6, wherein the urging section is a spring one end of which is connected to a connection point X in the first arm, and the other end of which is connected to a connection point Y in the second arm, and when an angle XOY at the roller paper side is XOY>180°, the urging section urges the second arm in the first rotation direction.

8. The apparatus of claim 7, wherein when the roll paper side angle is XOY<180°, the urging section urges the second arm in the second rotation direction.

9. A printing apparatus comprising a printing unit which can be pulled out and housed through an opening formed in the printing apparatus, wherein the printing unit comprises:

a paper holding section including a side wall and a paper holding shaft cantilevered at the side wall and rotatably holding a roll paper in which a paper is wound into a roll shape, the paper holding shaft being inserted into the roll paper;

a contact body supported rotatably at a support point O with respect to the printing unit and provided openable and closable to a first end surface of the roll paper opposite to a second end surface of the roll paper held by the paper holding shaft at a side of the side wall, according to a pull-out operation of the printing unit with respect to the printing apparatus; and an urging section which is a spring having a first end connected to a connection point X in the printing unit and a second end connected to a connection point Y in the contact body, the urging section urges the contact body in a first rotation direction in which the second end surface of the roll paper is opened when an angle XOY at the roller paper side is XOY>180° and urges the contact body in a second rotation direction which is opposite to the first rotation direction when the roll paper side angle is XOY<180°.

* * * * *